US007483011B2

(12) United States Patent
Yang et al.

(10) Patent No.: US 7,483,011 B2
(45) Date of Patent: Jan. 27, 2009

(54) APPARATUS AND METHOD OF CONVERTING IMAGE SIGNAL FOR FOUR-COLOR DISPLAY DEVICE, AND DISPLAY DEVICE INCLUDING THE SAME

(75) Inventors: Young-Chol Yang, Gunpo-si (KR); Baek-Woon Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 724 days.

(21) Appl. No.: 11/023,955

(22) Filed: Dec. 28, 2004

(65) Prior Publication Data

US 2005/0219274 A1 Oct. 6, 2005

(30) Foreign Application Priority Data

Dec. 30, 2003 (KR) ..... 10-2003-0100063

(51) Int. Cl.
*G09G 3/36* (2006.01)

(52) U.S. Cl. ..... 345/88; 345/690

(58) Field of Classification Search ..... 345/600, 345/589, 77, 88; 382/162, 167; 358/1.9
See application file for complete search history.

(56) References Cited

U.S. PATENT DOCUMENTS 5,929,843 A 7/1999 Tanioka
6,453,067 B1 * 9/2002 Morgan et al. ..... 382/162
6,724,934 B1 * 4/2004 Lee et al. ..... 382/167
6,750,874 B1 * 6/2004 Kim ..... 345/600
6,897,876 B2 * 5/2005 Murdoch et al. ..... 345/589
6,954,191 B1 * 10/2005 Hirano et al. ..... 345/77
2002/0063670 A1 5/2002 Yoshinaga et al.
2002/0122160 A1 9/2002 Kunzman
2004/0222999 A1 * 11/2004 Choi et al. ..... 345/589
2004/0223005 A1 * 11/2004 Lee ..... 345/690

FOREIGN PATENT DOCUMENTS

| | | |
|---|---|---|
| JP | 03-291453 | 12/1991 |
| JP | 08-289164 | 11/1996 |
| JP | 09-163162 | 6/1997 |
| JP | 2001-147666 | 5/2001 |
| JP | 2001-154636 | 6/2001 |
| JP | 2002-149116 | 5/2002 |
| JP | 2002-229531 | 8/2002 |
| KR | 1997-0049858 | 7/1997 |
| KR | 100314097 | 10/2001 |
| KR | 2002-0013831 | 2/2002 |
| KR | 1020030067485 | 8/2003 |
| WO | 0137249 A2 | 5/2001 |

* cited by examiner

*Primary Examiner*—Amare Mengistu
*Assistant Examiner*—Yuk Chow
(74) *Attorney, Agent, or Firm*—F. Chau & Assoc., LLC

(57) ABSTRACT

A method of converting image signals for a display device including six-color subpixels is provided, which includes: classifying three-color input image signals into maximum, middle, and minimum; decomposing the classified signals into six-color components; determining a maximum among the six-color components; calculating a scaling factor; and extracting six-color output signals.

44 Claims, 9 Drawing Sheets

APPARATUS AND METHOD OF CONVERTING IMAGE SIGNAL FOR FOUR-COLOR DISPLAY DEVICE, AND DISPLAY DEVICE INCLUDING THE SAME

BACKGROUND OF THE INVENTION (a) Field of the Invention

The present invention relates to an apparatus and a method of converting image signal for four-color display device, and a display device including the same.

(b) Description of Related Art

In recent, flat panel displays have been developed widely such as organic light emitting displays (OLEDs), plasma display panels ("PDPs") and liquid crystal displays ("LCDs") instead of heavy and large cathode ray tubes ("CRTs").

The PDPs are devices which display characters or images using plasma generated by gas-discharge, and the OLEDs are devices which display characters or images using electric field light-emitting of specific organics or high molecules. The LCDs are devices which display desired images by applying electric field to liquid crystal layer between two panels and regulate the strength of the electric field to adjust the transmittance of light passing through the liquid crystal layer.

Although the flat panel displays usually display colors using three primary colors such as red, green and blue, recently, especially in case of LCDs, for increasing the luminance, a white pixel (or a transparent pixel) is added to the three-color pixels, which is called four-color flat panel displays. The four-color flat panel displays display images after converting inputted three-color image signals are into four-color image signals.

Generally, the lower is chroma, the larger is the gamut of the luminance (or brightness) which even the same color can have, and alternatively, the higher is chroma, the more limited is the gamut thereof. Therefore, in the four-color flat panel displays, an effect of the luminance increase due to addition of the white pixel depends on the chroma. With this, a problem of color-change or simultaneous contrast occurs. The simultaneous contrast means that, for example, when watching smaller squares of the same color located within two or three larger squares, the smaller squares of the same color are recognized differently depending on the luminance of the larger squares.

SUMMARY OF THE INVENTION

An apparatus of converting input three-color image signals into four-color image signals including a white signal and output three-color signals is provided, which includes: a value extracting unit that extracts a maximum input and a minimum input among a set of input three-color image signals; an area determining unit that determines which of scaling areas the set of input three-color image signals belong to on the basis of the maximum input and the minimum input; and a four-color converting unit that converts the set of input three-color image signals into a set of four-color signals depending on the area determination, wherein the scaling areas includes a fixed scaling area and a variable scaling area, and the four-color converting unit performs fixed scaling with a fixed scaling factor when the set of input three-color image signals belongs to the fixed scaling area and performs variable scaling when the set of input three-color image signals belongs to the variable scaling area depending on the set of input three-color image signals.

The variable scaling may increase a value of the set of input three-color image signals by an increment smaller than the fixed scaling.

The fixed scaling may include: an increasing mapping that multiplies the scaling factor to the set of input three-color image signals to generate increased values; and an extraction that makes a minimum value among the increased values be a white signal and makes the increased values subtracted by the minimum value be output three-color signals.

The variable scaling may include: an increasing mapping that multiplies the scaling factor to the set of input three-color image signals to generate increased values; a decreasing mapping that increases the increased values depending on values of the set of input three-color image signals to generate decreased value; and an extraction that makes a minimum value among the decreased values be a white signal and makes the decreased values subtracted by the minimum value be output three-color signals.

The decreasing mapping may classify the increased values into at least two sub-regions and may apply different functions to different sub-regions.

The at least two sub-regions may be classified based on a maximum of the increased values.

The number of the at least two sub-regions may be more than two and the functions may be linear.

The fixed scaling area and the variable scaling area may be determined by a ratio of the maximum input and the minimum input.

The variable scaling area may include at least two sub-areas and the variable scaling applies different functions to the at least two sub-areas.

The number of the at least two sub-areas of the variable scaling area may be more than two and the functions are linear.

At least one of the functions is nonlinear, and in particular, quadratic.

An apparatus of converting input three-color image signals into four-color image signals including a white signal and output three-color signals is provided, which includes: a value extracting unit that extracts a maximum input and a minimum input among each set of input three-color image signals; an area determining unit that determines which of a fixed scaling area and a variable scaling area each set of input three-color image signals belong to on the basis of a ratio of the maximum input and the minimum input; and a four-color signal generating unit that converts each set of input three-color image signals into a set of four-color signals, the conversion applying a different mapping to a first set of input three-color image signals belonging to the fixed scaling area from a mapping applied to a second set of input three-color image signals belonging to the variable scaling area, wherein the four-color signal generating unit: for the second set of input three-color image signals, classifies first converted values, which are generated by multiplying a scaling factor to the second set of input three-color image signals, into at least two sub-regions, applies different functions to the at least two sub-regions to generate second converted values, and makes a minimum value among the second converted values be a white signal and makes the second converted values subtracted by the minimum value be output three-color signals; and for the first set of input three-color image signals, makes a minimum value among converted values, which are generated by multiplying the scaling factor to the first set of input three-color image signals, be a white signal and makes the converted values subtracted by the minimum value be output three-color signals.

The second converted values may be equal to or smaller than the first converted values.

The sub-regions may be partitioned by a line represented by $y=[(w+v1)/w]x+(1-v1)(0<v1<1)$, where x and y are minimum and maximum of the first converted values and (1+w) is the scaling factor.

The second converted values for a sub-region disposed under the line $y=[(w+v1)/w]x+(1-v1)$ may be equal to the first converted values therefor, at least one of the second converted values for a sub-region disposed over the line $y=[(w+v1)/w]x+(1-v1)$ may be a linear or quadratic function of the first converted values therefor, and the linear function may have a gradient smaller than one.

The number of the sub-regions may be at least three and the sub-regions may be partitioned by a first line represented by $y=[(w+v1)/w]x+(1-v1)(0<v1<1)$ and a second line represented by $y=(1-v2)x+(1+w*v2)(0<v2<1)$, where x and y are minimum and maximum of the first converted values and (1+w) is the scaling factor.

The second converted values for a sub-region disposed under the first line may be equal to the first converted values therefor, the second converted values for a sub-region disposed between the first line and the second line may be linear functions of the first converted values therefor having a gradient smaller than one, and the second converted values for a sub-region disposed over the second line may be constants independent of the first converted values therefor.

A method of converting input three-color image signals including red, green, and blue signals into four-color image signals including a white signal and output three-color signals is provided, which includes: classifying input three-color image signals forming a set into maximum, minimum, and middle; determining which of a first conversion area and a second conversion area the set of input three-color image signals belong to based on a ratio of the maximum and the minimum; multiplying a multiplier to the input three-color image signals that belong to the first conversion area; converting the input three-color image signals belonging to the second conversion area into converted values that are larger than the input three-color image signals and smaller than the input three-color image signals multiplied by the multiplier; extracting a minimum of the converted values as a white signal; and extracting the converted values subtracted by the minimum of the converted values as output three-color signals.

The conversion may include: generating the first converted values by multiplying the multiplier to the input three-color image signals; classifying the first converted values into a plurality of sub-regions; and converting the first converted values into the second converted values by applying different functions to the sub-regions.

At least one of the functions may be linear.

The functions may include three lines having different gradients, and at least one of the lines may have a gradient larger than zero and smaller than one.

The functions may include a nonlinear function, and in particular, a quadratic function. The functions further may include a nonlinear function.

The quadratic function may have a tangential gradient equal to a gradient of the linear function at a boundary of the sub-regions.

A gradient of the linear function may be equal to one.

A display device including a plurality of pixels is provided, which includes: an image signal converter converting input three-color image signals into four-color image signals including a white signal and output three-color signals; and a data driver supplying data voltages corresponding the four-color image signals to the pixels, wherein the image signal converter comprises: a value extracting unit that extracts a maximum input and a minimum input among a set of input three-color image signals; an area determining unit that determines which of scaling areas the set of input three-color image signals belong to on the basis of the maximum input and the minimum input; and a four-color converting unit that converts the set of input three-color image signals into a set of four-color signals depending on the area determination, wherein the scaling areas includes a fixed scaling area and a variable scaling area, and the four-color converting unit performs fixed scaling with a fixed scaling factor when the set of input three-color image signals belongs to the fixed scaling area and performs variable scaling when the set of input three-color image signals belongs to the variable scaling area depending on the set of input three-color image signals.

The variable scaling may increase a value of the set of input three-color image signals by an increment smaller than the fixed scaling.

The fixed scaling may include: an increasing mapping that multiplies the scaling factor to the set of input three-color image signals to generate increased values; and an extraction that makes a minimum value among the increased values be a white signal and makes the increased values subtracted by the minimum value be output three-color signals.

The variable scaling may include: an increasing mapping that multiplies the scaling factor to the set of input three-color image signals to generate increased values; a decreasing mapping that increases the increased values depending on values of the set of input three-color image signals to generate decreased value; and an extraction that makes a minimum value among the decreased values be a white signal and makes the decreased values subtracted by the minimum value be output three-color signals.

The decreasing mapping may classify the increased values into at least two sub-regions and may apply different functions to different sub-regions.

The at least two sub-regions may be classified based on a maximum of the increased values.

The number of the at least two sub-regions may be more than two and the functions may be linear.

The fixed scaling area and the variable scaling area may be determined by a ratio of the maximum input and the minimum input.

The variable scaling area may include at least two sub-areas and the variable scaling applies different functions to the at least two sub-areas.

The number of the at least two sub-areas of the variable scaling area may be more than two and the functions are linear.

At least one of the functions is nonlinear, and in particular, quadratic.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF EMBODIMENTS

The present invention now will be described more fully hereinafter with reference to the accompanying drawings, in which preferred embodiments of the inventions invention are shown. This invention may, however, be embodied in many different forms and should not be construed as limited to the embodiments set forth herein.

Now, a four-color LCD and apparatus and method of converting image signal thereof according to embodiments of the present invention will be described with reference to the drawings.

Figure 1:
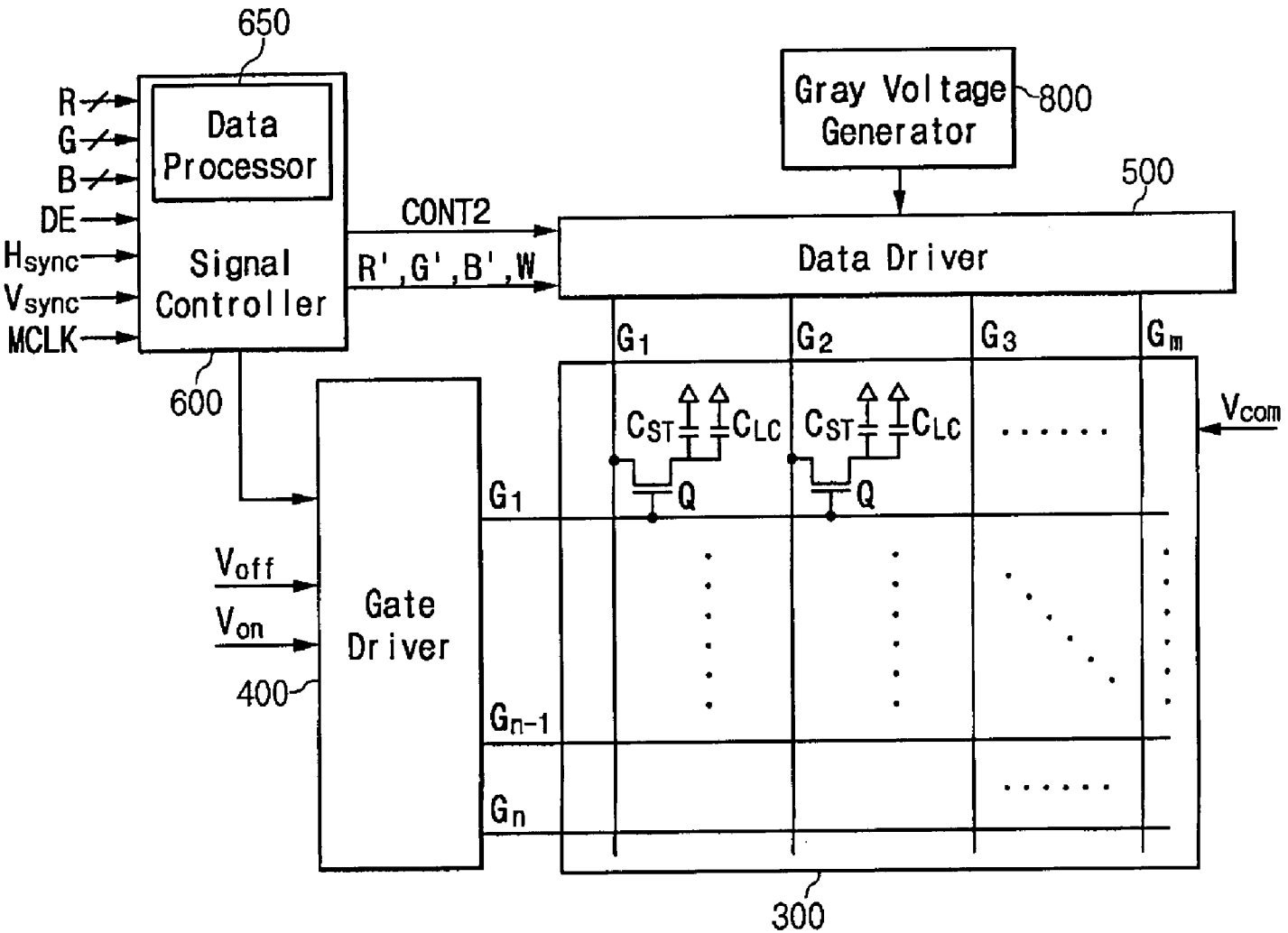
FIG. 1 is a block diagram of an LCD according to an embodiment of the present invention.
Figure 2:
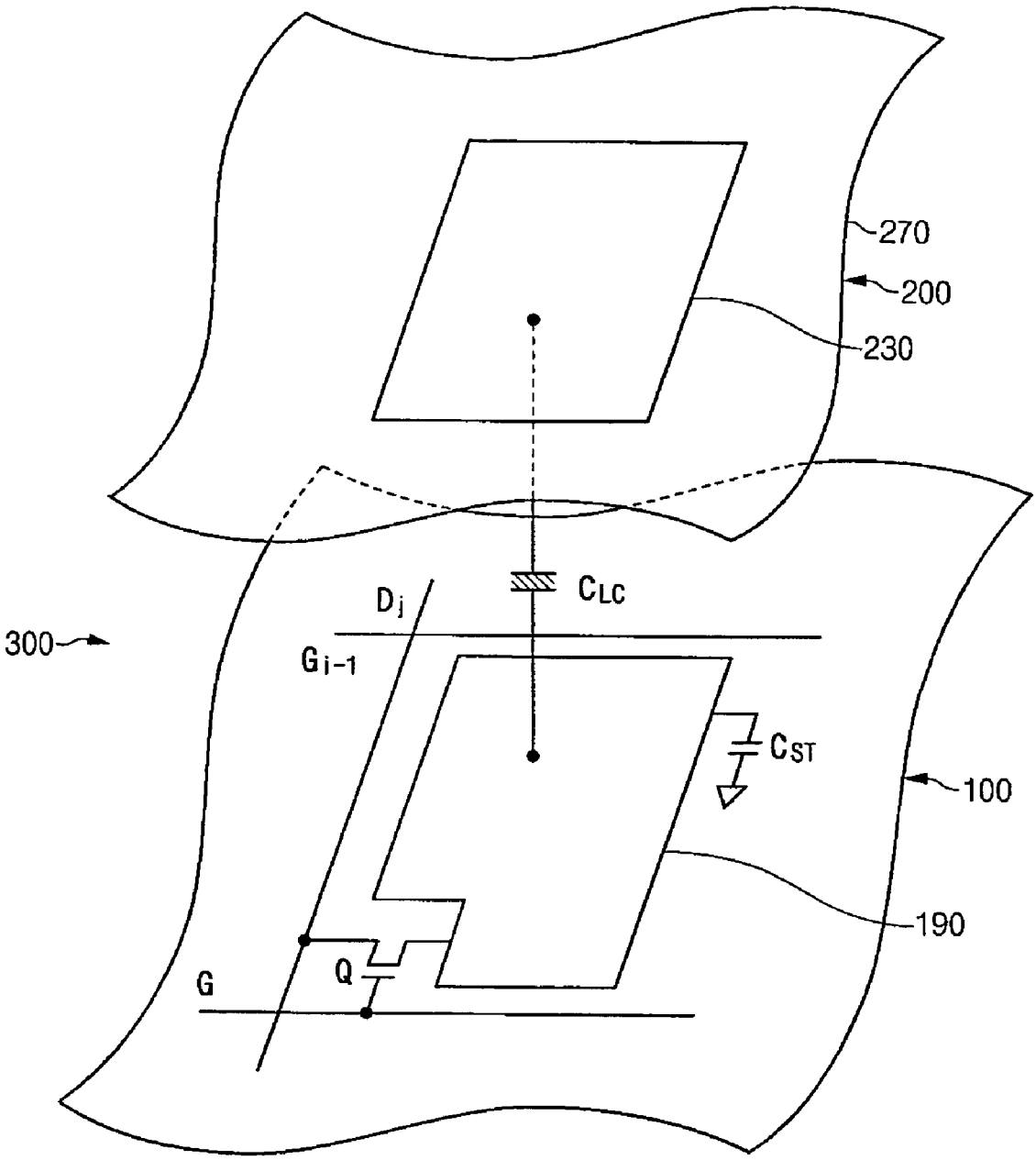
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment includes a LC panel assembly 300, a gate driver 400 and a data driver 500 that are connected to the panel assembly 300, a gray voltage generator 800 connected to the data driver 500, and a signal controller 600 controlling the above elements.

Referring to FIG. 1, the panel assembly 300 includes a plurality of display signal lines $G_1$-$G_n$ and $D_1$-$D_m$ and a plurality of pixels connected thereto and arranged substantially in a matrix. In a structural view shown in FIG. 2, the panel assembly 300 includes lower and upper panels 100 and 200 and a LC layer 3 interposed therebetween.

The display signal lines $G_1$-$G_n$ and $D_1$-$D_m$ are disposed on the lower panel 100 and include a plurality of gate lines $G_1$-$G_n$ transmitting gate signals (also referred to as "scanning signals"), and a plurality of data lines $D_1$-$D_m$ transmitting data signals. The gate lines $G_1$-$G_n$ extend substantially in a row direction and they are substantially parallel to each other, while the data lines $D_1$-$D_m$ extend substantially in a column direction and they are substantially parallel to each other.

Each pixel includes a switching element Q connected to the display signal lines $G_1$-$G_n$ and $D_1$-$D_m$,and a LC capacitor $C_{LC}$ and a storage capacitor $C_{ST}$ that are connected to the switching element Q. If unnecessary, the storage capacitor $C_{ST}$ may be omitted.

The switching element Q such as a TFT is provided on the lower panel 100 and has three terminals: a control terminal connected to one of the gate lines $G_1$-$G_n$; an input terminal connected to one of the data lines $D_1$-$D_m$; and an output terminal connected to both the LC capacitor $C_{LC}$ and the storage capacitor $C_{ST}$.

The LC capacitor $C_{LC}$ includes a pixel electrode 190 provided on the lower panel 100 and a common electrode 270 provided on an upper panel 200 as two terminals. The LC layer 3 disposed between the two electrodes 190 and 270 functions as dielectric of the LC capacitor $C_{LC}$. The pixel electrode 190 is connected to the switching element Q, and the common electrode 270 is supplied with a common voltage Vcom and covers an entire surface of the upper panel 100200. Unlike FIG. 2, the common electrode 270 may be provided on the lower panel 100, and both electrodes 190 and 270 may have shapes of bars or stripes.

The storage capacitor $C_{ST}$ is an auxiliary capacitor for the LC capacitor $C_{LC}$. The storage capacitor $C_{ST}$ includes the pixel electrode 190 and a separate signal line (not shown), which is provided on the lower panel 100, overlaps the pixel electrode 190 via an insulator, and is supplied with a predetermined voltage such as the common voltage Vcom. Alternatively, the storage capacitor $C_{ST}$ includes the pixel electrode 190 and an adjacent gate line called a previous gate line, which overlaps the pixel electrode 190 via an insulator.

For color display, each pixel uniquely represents one of three primary colors such as red, green and blue and white (i.e., spatial division) or each pixel sequentially represents the four colors in turn (i.e., temporal division), such that spatial or temporal sum of the four colors are recognized as a desired color. FIG. 2 shows an example of the spatial division that each pixel includes a color filter 230 representing one of the three primary colors or whit (transparency) in an area of the upper panel 200 facing the pixel electrode 190. Alternatively, the color filter 230 is provided on or under the pixel electrode 190 on the lower panel 100.

One or more polarizers (not shown) polarizing the light are attached on the outer surfaces of the panels 100 and 200 of the panel assembly 300.

The gray voltage generator 800 generates two sets of a plurality of gray voltages related to the transmittance of the pixels. The gray voltages in one set have a positive polarity with respect to the common voltage Vcom, while those in the other set have a negative polarity with respect to the common voltage Vcom.

The gate driver 400 is connected to the gate lines $G_1$-$G_n$ of the panel assembly 300 and synthesizes the gate-on voltage Von and the gate-off voltage Voff from an external device to generate gate signals for application to the gate lines $G_1$-$G_n$.

The data driver 500 is connected to the data lines $D_1$-$D_m$ of the panel assembly 300 and applies data voltages, which are selected from the gray voltages supplied from the gray voltage generator 800, to the data lines $D_1$-$D_m$.

The drivers 400 and 500 may include at least one integrated circuit (IC) chip mounted on the panel assembly 300 or on a flexible printed circuit (FPC) film in a tape carrier package (TCP) type, which are attached to the LC panel assembly 300. Alternately, the drivers 400 and 500 may be integrated into the panel assembly 300 along with the display signal lines $G_1$-$G_n$ and $D_1$-$D_m$ and the TFT switching elements Q.

The signal controller 600 controls the drivers 400 and 500 and includes a data processor 650.

Now, the operation of the above-described LCD will be described in detail.

The signal controller 600 is supplied with input three-color image signals R, G and B and input control signals controlling the display thereof such as a vertical synchronization signal Vsync, a horizontal synchronization signal Hsync, a main clock MCLK, and a data enable signal DE, from an external graphics controller (not shown). After generating gate control signals CONT1 and data control signals CONT2 and processing the input image signals R, G and B suitable for the operation of the panel assembly 300 on the basis of the input control signals and the input image signals R, G and B, the signal controller 600 provides the gate control signals CONT1 for the gate driver 400, and the processed image signals R', G', B' and W and the data control signals CONT2 to the data driver 500. The processing of the signal controller 600 includes four-color rendering that coverts three-color signals into four-color signals, which is performed by the data processor 650.

The gate control signals CONT1 include a scanning start signal STV for instructing to start scanning and at least a clock signal for controlling the output time of the gate-on voltage Von. The gate control signals CONT1 may further include an output enable signal OE for defining the duration of the gate-on voltage Von.

The data control signals CONT2 include a horizontal synchronization start signal STH for informing of start of data transmission for a group of pixels, a load signal. LOAD for instructing to apply the data voltages to the data lines $D_1$-$D_m$, and a data clock signal HCLK. The data control signal CONT2 may further include an inversion signal RVS for reversing the polarity of the data voltages (with respect to the common voltage Vcom).

Responsive to the data control signals CONT2 from the signal controller 600, the data driver 500 receives a packet of the image data R', G', B' and W for the group of pixels from the signal controller 600, converts the image data R', G', B' and W into analog data voltages selected from the gray voltages supplied from the gray voltage generator 800, and applies the data voltages to the data lines $D_1$-$D_m$.

The gate driver 400 applies the gate-on voltage Von to the gate line $G_1$-$G_n$ in response to the gate control signals CONT1 from the signal controller 600, thereby turning on the switching elements Q connected thereto. The data voltages applied to the data lines $D_1$-$D_m$ are supplied to the pixels through the activated switching elements Q.

The difference between the data voltage and the common voltage Vcom is represented as a voltage across the LC capacitor $C_{LC}$, which is referred to as a pixel voltage. The LC molecules in the LC capacitor $C_{LC}$ have orientations depending on the magnitude of the pixel voltage, and the molecular orientations determine the polarization of light passing through the LC layer 3. The polarizer(s) convert(s) the light polarization into the light transmittance.

By repeating this procedure by a unit of the horizontal period (which is denoted by "1H" and equal to one period of the horizontal synchronization signal Hsync and the data enable signal DE), all gate lines $G_1$-$G_n$ are sequentially supplied with the gate-on voltage Von during a frame, thereby applying the data voltages to all pixels. When the next frame starts after finishing one frame, the inversion control signal RVS applied to the data driver 500 is controlled such that the polarity of the data voltages is reversed (which is referred to as "frame inversion"). The inversion control signal RVS may be also controlled such that the polarity of the data voltages flowing in a data line in one frame are reversed (for example, row inversion and dot inversion), or the polarity of the data voltages in one packet are reversed (for example, column inversion and dot inversion).

Now, a method of converting image signal of a four-color LCD including red, green, blue, and white pixels according to the present invention will be described in detail with reference to FIGS. 3 to 7.

Figure 3:
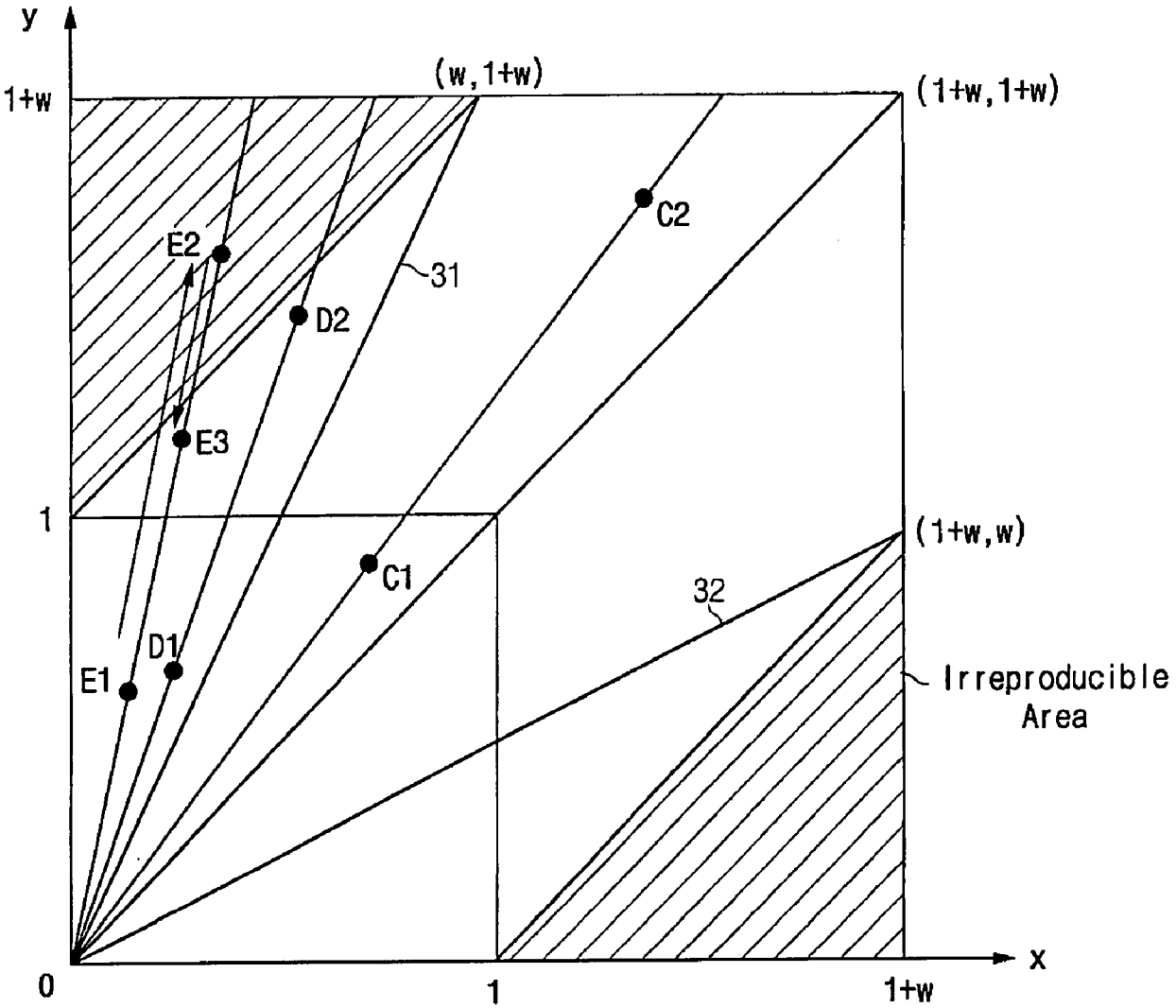
FIGS. 3 to 7 are graphs for illustrating a method of converting three-color image signal into four-color image signals according to an embodiment of the present invention.

FIG. 3 is a normalized color space illustrating signal conversion according to embodiments of the present invention.

First, a basic principle of converting three-color image signals into four-color image signals according to an embodiment of the present invention will be described in detail.

Consider a set of input image signals including a red input signal R, a green input signal G, and a blue input signal B and let Min (R, G, B), Max (R, G, B), and Mid (R, G, B) be normalized luminances represented by the image signals having the lowest gray, the highest gray, and the middle gray (referred to as "minimum image signal," "minimum image signal," and "middle image signal, respectively, hereinafter), respectively. For descriptive convenience, the luminance, the gray, and the value of an image signal are used to indicate the same meaning.

In FIG. 3, a horizontal axis (i.e., x axis) and a vertical axis (i.e., y axis) represent the minimum luminance Min (R, G, B) and the maximum luminance Max (R, G, B), and converted values thereof, respectively. When the bit number of the input image signals R, G and B is eight, the gray and the luminance represented by the image signals R, G and B have 256 levels in total from 0-th to 255-th level, and the normalized values of the levels are 0, 1/255, 2/255, . . . , and 1. For example, if the luminances of the red signal R, the green signal G, and the blue signal B are 255, 100, and 60, respectively, the luminance of the blue signal B is the lowest and that of the red signal R is the highest, and thus, x coordinate of the set of image signals R, G and B is equal to 60/255 and y coordinate thereof is equal to 255/255 (=1).

It is noted that a color is represented by a straight line passing through the origin (0, 0) and different points in the straight line represent different luminances.

Increasing Mapping—Primary Rule

Any set of three-color input image signals is represented as a point in a square area having vertices (0, 0), (1, 0), (1, 1), and (01) (referred to as "three-color space" hereinafter). Assuming that the ratio of a maximum luminance of a white pixel to a sum of maximum luminances of red, green, and blue pixels is equal to w, the sum of the maximum luminances of the red, green, blue, and white pixels is equal to (1+w). Accordingly, the addition of a white pixel can increase the luminance for a given color represented by the set of the input image signals as much as w up to maximum. The conversion principle is based on this fact. A primary rule is that a point C1 representing a set of three-color image signals is mapped into a point C2 disposed in a straight line connecting the point C1 and the origin (0, 0) and having a distance from the origin (0, 0) (1+w) times a distance of the point C1 from the origin (0, 0). Accordingly, a point (Min (R, G, B), Max (R, G, B)) is mapped into a point ((1+w) Min (R, G, B), (1+w) Max (R, G, B)), and in this case, the multiplier (1+w) is referred to as a scaling factor. The above-described mapping is referred to as "increasing mapping" since it increases the distance from the origin (0, 0).

However, the luminance for a pure color such as red, green and blue cannot be increased by the addition of the white pixel, and an increment of the luminance is lower as the color is closer to a pure color. For example, as shown in FIG. 3, a point E1 representing a set of three-color image signals is mapped into a point E2 if the above-described primary rule is applied thereto as it is. However, the point E2 represents a color that cannot be displayed by the four-color display.

Regulating this, colors represented by the points in a hexagonal area having vertices (0, 0), (1, 0), (1+w, w), (1+w, 1+w), (w1+w), and (0, 1) can be displayed by a four-color display, while colors represented by the points in a hatched triangular area having vertices (1, 0), (1+w, 0), and (1+w, w) and a triangular area having vertices (0, 1), (0, 1+w), and (w, w+1) cannot be displayed by the four-color display. Hereinafter, the hexagonal area defined by (0, 0), (1, 0), (1+w, w), (1+w, 1+w), (w1+w), and (0, 1) is referred to as "reproducible area" and the hatched triangular area defined by the points (1, 0), (1+w, 0), and (1+w, w) and the hatched triangular area defined by the points (0, 1), (0, 1+w), and (w, w+1) are referred to as "irreproducible area."

Therefore, points mapped into those in the irreproducible area are subjected to a secondary mapping that maps the points in the irreproducible area into the reproducible area.

Fixed Scaling Area and Variable Scaling Area

First, it is noted that the points representing any set of input image signals and their mapping points are always located at on or over a line y=x shown in FIG. 3 since the x axis represents the minimum image signal and the y axis represents the maximum image signal.

The increasing mapping of any points under a line 31 connecting the origin (0, 0) and the point (w, 1+w) yields a point located in the reproducible area. Therefore, the points in such an area are subjected to only a primary mapping with the above-described scaling factor of (1+w), and this area is called a fixed scaling area. The line 31 is expressed as y=(1+w)x/w, and thus, the points (x, y) in the fixed scaling area meets y<(1+w)x/w. Substituting x and y with Min and Max, respectively, $$(1+w)/w<\text{Max}/\text{Min}. \quad (1)$$

On the contrary, points (Min, Max) satisfying (1+w)/w>Max/Min are primary-mapped (or increasingly mapped) into points in the reproducible area or the irreproducible area. In detail, if a point (Min, Max) is primary-mapped into points ((1+w)Min, (1+w)Max) disposed under a straight line y=x+1, which is a boundary line between the reproducible area and the irreproducible area, that is, $$(1+w)(\text{Min}-\text{Max})<1, \quad (2)$$

the point ((1+w)Min, (1+w)Max) is located in the reproducible area, and, otherwise, the point ((1+w)Min, (1+w)Max) is located in the irreproducible area.

Accordingly, a resultant mapping of the points (Min, Max) satisfying (1+w)/w>Max/Min, which may be a composite of the primary mapping and the above-described secondary mapping, is determined to have a scaling factor smaller than (1+w) and depending on the input image signals. Thus, this area is referred to as a variable scaling area.

Decreasing Mapping—Secondary Rule

A secondary mapping of the points in the variable scaling area will be described in detail with reference to FIG. 4.

Figure 4:
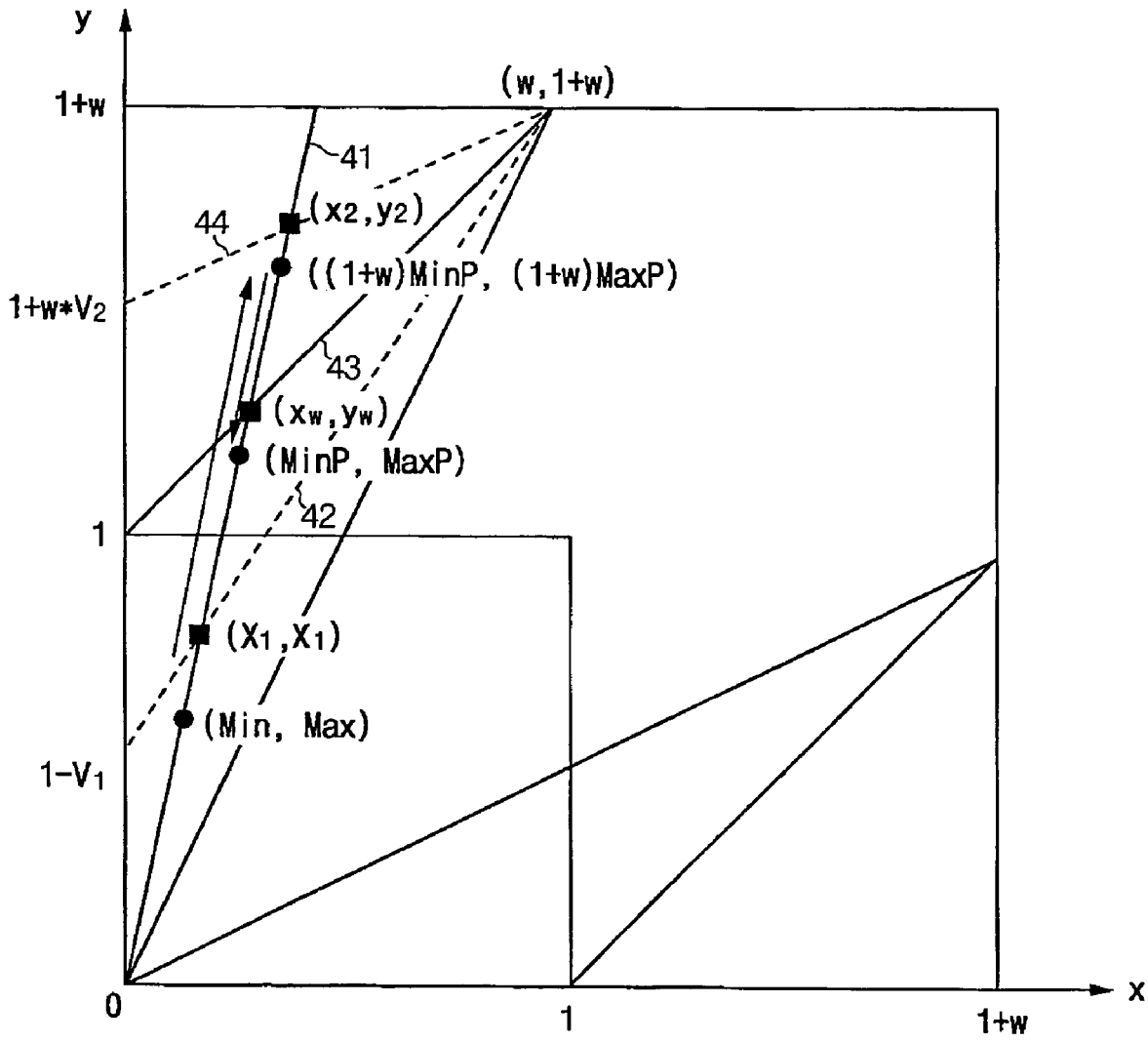

In FIG. 4, a horizontal axis and a vertical axis represent normalized luminance and the minimum image signals and the maximum image signals performing the increasing mapping and decreasing mapping, respectively.

Referring to FIG. 4, for the points (Min, Max) in the variable scaling area is increasingly mapped by (1+w) times into a point ((1+w) Min, (1+w)Max), which in turn is decreasingly mapped into another point (MinP, MaxP) in the reproducible area.

1. Principles of Decreasing Mapping

It is preferable that the decreasing mapping maps a point (Min, Max) to a point (MinP, MaxP) located on a line 41 connecting the origin (0, 0) and the point (Min, Max), i.e., y=(Max/min)x for color conservation, and it maps a minimum point and a maximum point into a minimum point and a maximum point in the reproducible area, respectively, for conserving the order of gray or luminance. The minimum point on the line 41 in the reproducible area is also the origin (0, 0), and the maximum point is an intersection point of the lines 41 and 43, which has a coordinate ($x_w$, $y_w$)

$$(x_w, y_w)=(\text{Min}/(\text{Max}-\text{Min}), \text{Max}/(\text{Max}-\text{Min})). \quad (3)$$

2. Introduction of Sub-Region

The points (MinP, MaxP) are classified into at least two sub-regions, which are obtained by applying different mappings. When the number of the sub-regions are three, there are many different ways of determining the sub-regions, and for example, the sub-regions are partitioned by two lines 42 and 44 connecting a point (w, 1+w) and points (0, 1−v1) and (0, 1+w×v2), respectively, and the line y=x+1, which is a border of the irreproducible area, is included in a sub-region disposed between the lines 42 and 44. Here, v1 and v2 are parameters introduced for a simple calculation, and may be determined depending on the characteristics of the display device.

A point (Min, Max) is mapped into a point located on the line 41 of y=(Max/Min)x.

Among the points located on the lines 41, the points in the sub-region disposed between the two lines 42 and 44 are disposed between an intersection (x1, y1) of the lines 41 and 42 and an intersection (x2, y2) of the lines 41 and 44.

Since an equation of the line 42 is y=[(w+v1)/w]x+(1−v1), the coordinates of the intersection (x1, y1) of the lines 41 and 42 is given by:

$$x1=(1-v1)/[(\text{Max}-\text{Min})/\text{Min}-v1/w]; \text{ and}$$

$$y1=x1\times\text{Max}/\text{Min}. \quad (4)$$

Since an equation of the line 44 is y=[(1−v2)x]+(1+w×v2), the coordinates of the intersection (x2, y2) of the lines 41 and 44 is given by:

$$x2=(1+w\times v2)/[(\text{Max}-\text{Min})/\text{Min}+v2]; \text{and}$$

$$y2=x2\times\text{Max}/\text{Min}. \quad (5)$$

However, the number of the sub-regions may be more than 4.

3. Twice-Curved Linear Mapping

Next, a mapping according to an embodiment of the present invention will be described in detail with reference to FIGS. 4 and 5.

Figure 5:
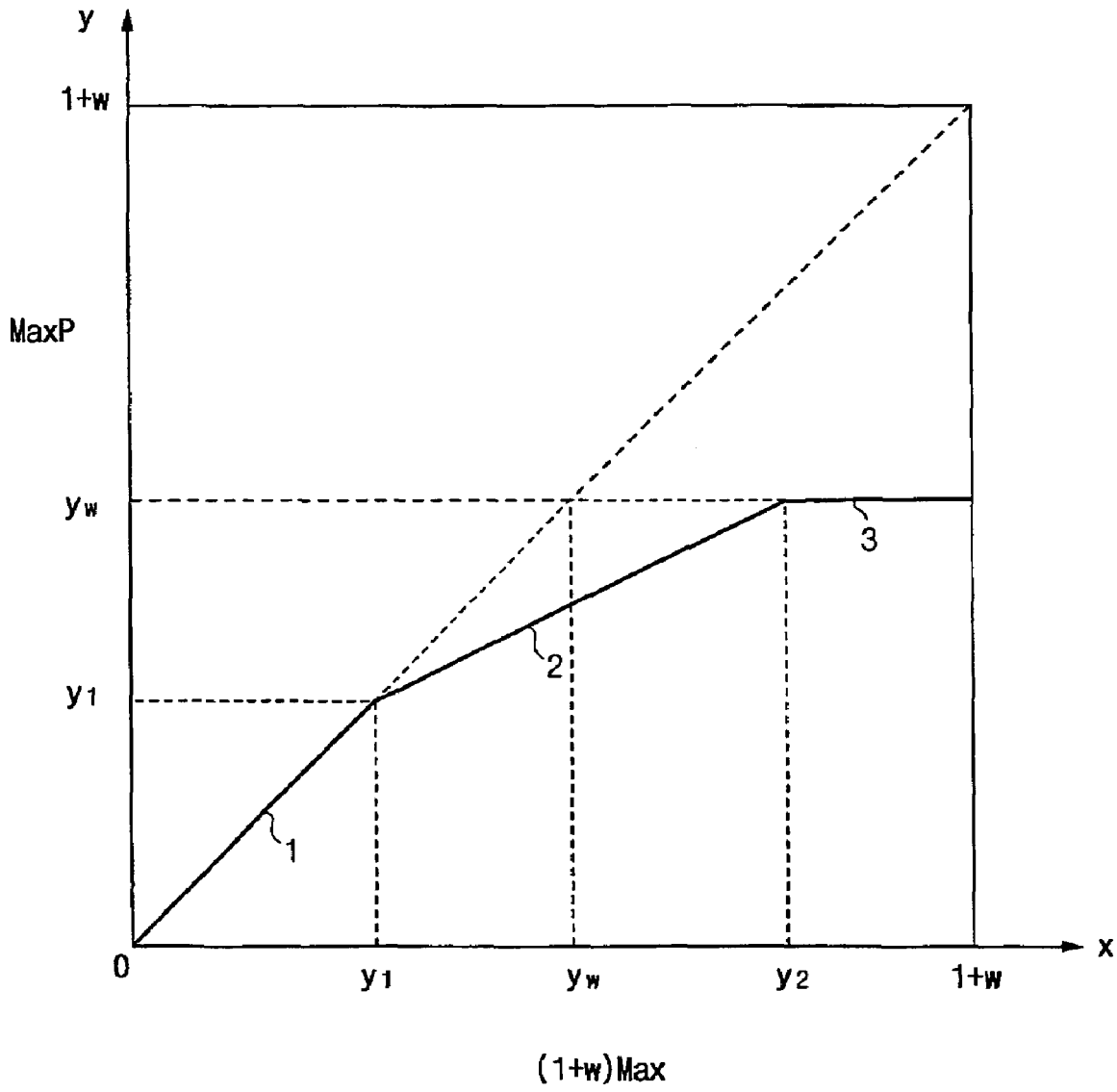

In FIG. 5, a horizontal axis (x) represents an increasingly mapped maximum image signal [(1+w)Max] and a vertical axis (y) represents a decreasingly mapped minimum image signal [MaxP].

Referring to FIGS. 4 and 5, the points located in the sub-region under the line 42 are mapped into themselves (as indicated by a line 1), the points located in the sub-region between the two lines 42 and 44 are mapped according to a linear function that maps y1 into y1 and y2 into $y_w$ (as indicated by a line 2), and the points located in the sub-region over the line 44 are mapped into a constant $y_w$ (as indicated by a line 3).

Therefore, the mapping in each sub-region is a linear mapping, which is given by:

$$\text{MaxP}=\text{Max if } 0=\text{Max}\leqq y1;$$

$$\text{Max}P=(y_w-y1)(\text{Max}-y1)/(y2-y1) \text{ if } y1=\text{Max}\leqq y2; \text{ and}$$

$$\text{Max}P=y_w \text{ if } y2=\text{Max}\leqq 1+w. \quad (6)$$

The resultant value MaxP of the maximum image signal Max can be obtained from Equation (6), and the resultant value MinP of the minimum image signal MinP can be obtained from the equation of the line 41, y=(Max/Min)x (i.e., MaxP=(Max/Min)MinP). Finally, the resultant value MidP of the middle image signal Mid is determined by the ratio of the three input image signals. That is, (a) MinP:MidP:MaxP=Min:Mid:Max or (b) MidP/MaxP=Mid/Max and MinP/MidP=Min/Mid. For example, when the resultant value of a red, maximum signal R is 100, the resultant value of the blue, minimum signal B is 60, and the ratio of three input image signals is 3:4:5, the resultant value of the green, middle signal G is determined as 80.

It is preferable that v1 and v2 >0. It is because, otherwise, only two sub-regions are obtained, and thus the reproductivity is limited. For example, if v2=0, since all the values of the interval from $y_w$ to y2 are mapped into the maximum value $y_w$, the luminance difference between the grays thereof disappears not to distinguish the images. For another example, if v1=0 and v2=1, the luminance difference between the grays for the entire interval from zero to (1+w), maintains but images may look dark as a whole.

3. Nonlinear Mapping

Now, a mapping according to another embodiment of the present invention will be described with reference to FIGS. 4 and 6.

Figure 6:
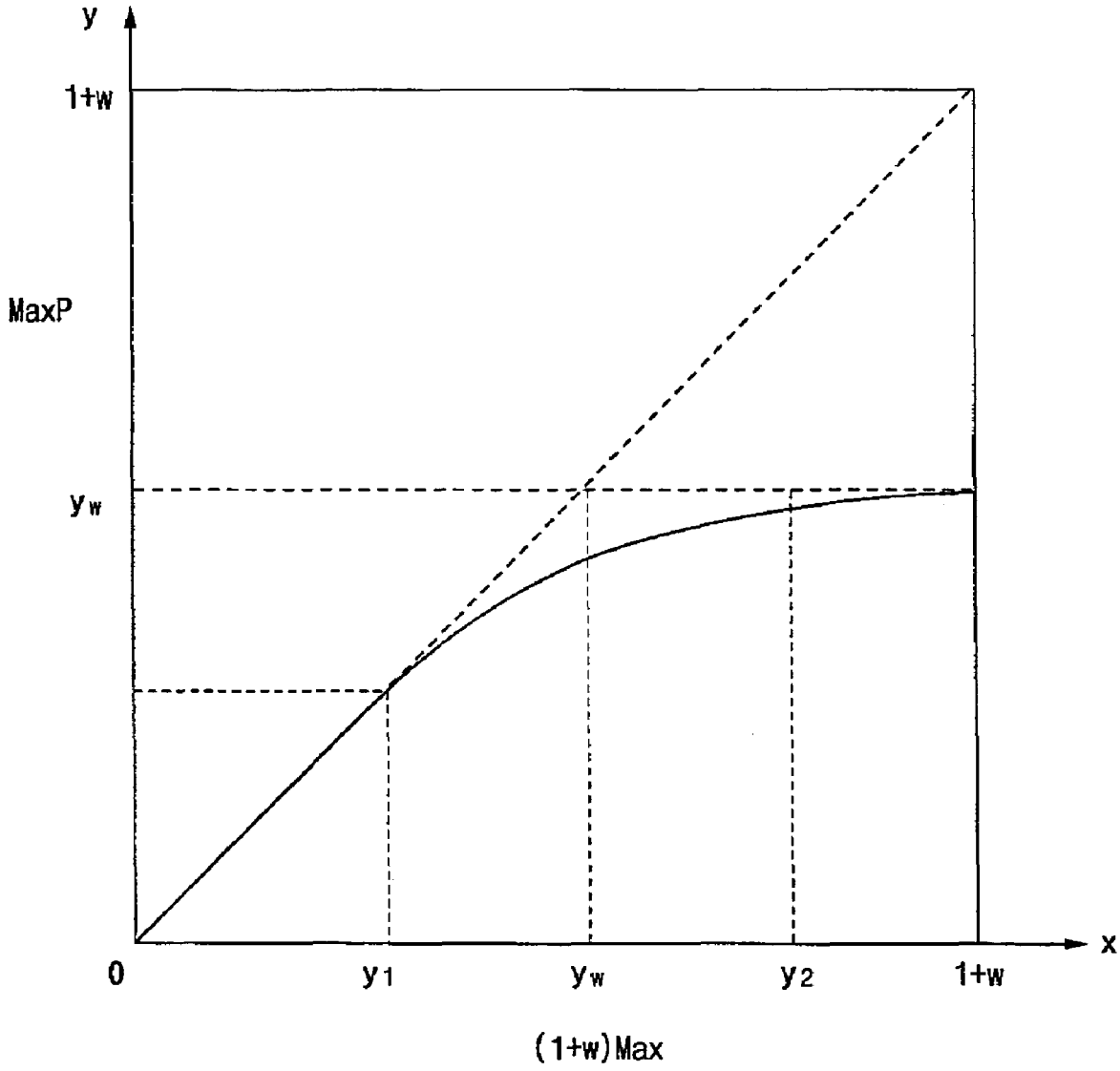

FIG. 6 is a view for explaining a conversion method according to another embodiment of the present invention.

In FIG. 6, a horizontal axis (x) represents an increasingly mapped maximum image signal (1+w)Max and a vertical axis (y) represents a decreasingly mapped minimum image signal MaxP.

Referring to FIGS. 4 and 6, only two sub-regions partitioned by the line 42 are presented rather than three sub-regions shown in FIG. 4. The mapping the points in the sub-region disposed below the line 42 into themselves like that shown in FIG. 5, while the points in the sub-region disposed over the line 42 are subjected to a nonlinear mapping including a quadratic function, which is given by:

$$\text{MaxP}=\text{Max if } 0=\text{Max}\leqq y1;\text{ and}$$

$$\text{Max}P=a\times\text{Max}^2+b\times\text{Max}+c \text{ if } y1=\text{Max}\leqq 1+w, \quad (7)$$

where a, b and c are coefficients.

Assuming MaxP=y and Max=x, the quadratic function $y=ax^2+bx+c$ preferably meets the following conditions:

(a) x=y1 for y=y1;

(b) a tangent at y=y1 is one; and (c)$y=y_w$ for x=(1+w)

The conditions (a) and (c) are given for the continuity of the mapping and the condition (b) is given for smoothness of the mapping at a boundary between the sub-regions.

Finding the constants a, b, and c from these conditions:

$$a=-(1+w-y_w)/(1+w-y1)^2;$$

$$b=1-2\times a\times y1;\text{ and}$$

$$c=y_w-(1+w)\times b^2-(1+w)^2\times a. \quad (8)$$

The resultant value MaxP of the maximum image signal Max can be obtained from Equations (7) and (8), the resultant value MinP of the minimum image signal MinP can be obtained from the equation of the line 41, y=(Max/Min)×(i.e., MaxP=(Max/Min)MinP), and the resultant value MidP of the middle image signal Mid is determined by the ratio of the three input image signals as described in the twice-curved mapping.

Extraction of Four-Color Image Signals

Now, extraction of four-color image signals including a white signal will be described in detail with reference to FIG. 7.

Figure 7:
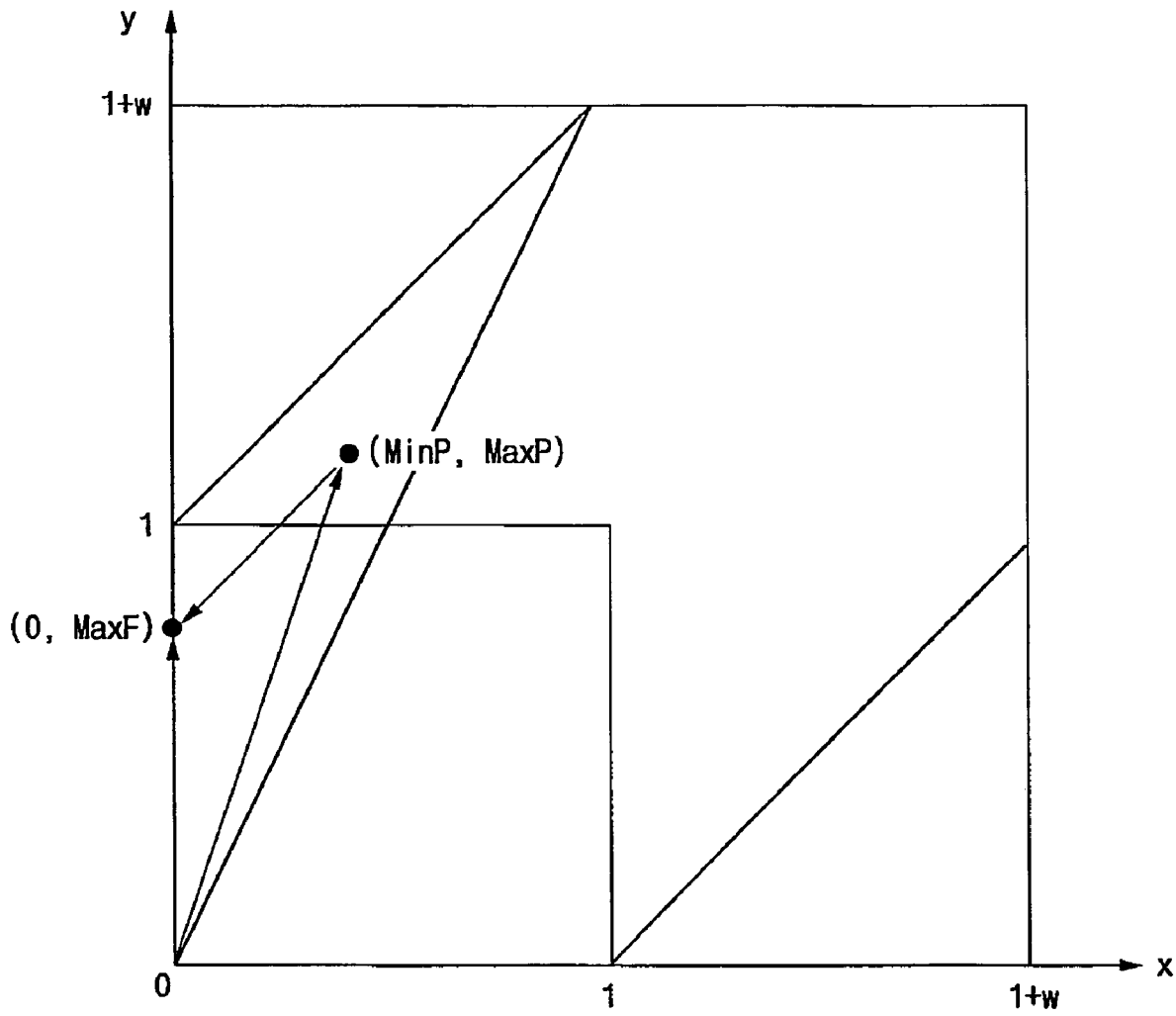

FIG. 7 shows a method of determining four-color image signals MinF(R, G, B), MidF(R, G, B), MaxF(R, G, B), and WF using the above-described intermediate values MinP(R, G, B), MidP(R, G, B), and MaxP(R, G, B), where MinF, MidF, MaxF and WF indicate finalized values of the minimum image signal, the middle image signal, the maximum image signal, and the white signal, respectively.

First, the value of the white signal WF is determined to be equal to the intermediate value (previously referred to as the resultant value) of the minimum image signal MinP. The residual finalized values MinF, MidF and MaxF are determined to be equal to from the intermediate values MinP, MidP, and MaxP subtracted by the minimum intermediate value MinP. That is, $$\text{Min}F=\text{Min}P-\text{Min}P=0;$$

$$\text{Mid}F=\text{Mid}P-\text{Min}P;$$

$$\text{Max}F=\text{Max}P-\text{Min}p;\text{ and}$$

$$\text{WF}=\text{MinP}. \quad (9)$$

Here, $$\text{Mid}F=\text{Mid}P-\text{Min}P=\text{Max}P\times(\text{Mid}P/\text{Max}P)\times(1-\text{Min}P/\text{Mid}P),\text{ and}$$

$$\text{Max}F=\text{Max}P-\text{Min}P=\text{Max}P\times(1-\text{Min}P/\text{Max}P). \quad (10)$$

As described above, since MidP/MaxP=Mid/Max, MinP/MidP=Min/Mid, and MinP/MaxP=Min/Max, $$\text{MinF}=0,$$

$$\text{Mid}F=\text{Max}P\times(\text{Mid}/\text{Max})\times[(\text{Mid}-\text{Min})/\text{Mid}],$$

$$\text{Max}F=\text{Max}P\times[(\text{Max}-\text{Min})/\text{Max}],\text{ and}$$

$$\text{WF}=\text{MinP}. \quad (11)$$

In the case of the twice-curved linear mapping shown in FIG. 5, the MaxP, which is obtained by substituting Equation 6 with Equation 3, and the MinP obtained according thereto are substituted for those in Equation (11), and this makes each of the finalized values MinF, MidF, MaxF, and WF expressed as a function of Max, Mid, Min, v1, and v2.

For example, if optimal values of the parameters v1 and v2 are equal to 0.25 and =1, respectively, in the twice-curved linear mapping, Equations (4) and (5) yield $$x1=3\text{Min}w/[4w(\text{Min}-\text{Max})-\text{Min}],$$

$$y1=3bw/[4w(\text{Min}-\text{Max})-\text{Min}],$$

$$x2=(1+w)\times\text{Min}/\text{Max},\text{ and}$$

$$y2=(1+w). \quad (12)$$

Equation (12) is substituted for Equation (6) to seek the values MaxP and MinP, and thereafter, the values MaxP and the MinP are substituted for those of Equation 11 to obtain the finalized values of the four-color image signals.

If the optimal value of the parameter v1 in the nonlinear mapping is equal to 1.0, Equation (3) yields $$x1=0,\text{ and}$$

$$y1=0. \quad (13)$$

Equation (13) is substituted for Equation (8) to obtain $$a=-(1+w-y_w)/(1+w)^2,$$

$$b=1,\text{ and}$$

$$c=0. \quad (14)$$

Equation (14) is substituted for Equation (7) to obtain $$\text{Max}P=[-(1+w-y_w)/(1+w)^2]\text{Max}^2+\text{Max}. \quad (15)$$

$y_w$=Max/(Max−Min) in Equation (3) is substituted for $y_w$ in Equation (15) to cause Equation (15) to be relatively simplified such as:

$$\text{Max}P=(1+w)(1-\text{Max})\text{Max}+\text{Max}^3/(\text{Max}-\text{Min}) \quad (16)$$

Substitution of the value MaxP for that of Equation 11 can make:

$$\begin{aligned} \mathrm{Max}F &= \mathrm{Max}P \times (1 - \mathrm{Min}/\mathrm{Max}) \\ &= (1+w)(1-\mathrm{Max})[\mathrm{Min}-\mathrm{Max}] + \mathrm{Max}^2 \\ &= (1-\mathrm{Max})[\mathrm{Min}-\mathrm{Max}] + \\ &\quad w(1-\mathrm{Max})[\mathrm{Min}-\mathrm{Max}] + \mathrm{Max}^2; \end{aligned} \tag{17}$$

$$\begin{aligned} MidF &= \mathrm{Max}P \times (Mid/\mathrm{Max}) \times (1 - \mathrm{Min}/Mid) \\ &= (1+w)(1-\mathrm{Max})(Mid-\mathrm{Min}) + \\ &\quad (Mid-\mathrm{Min})/(\mathrm{Max}-Mid)\mathrm{Max}^2; \text{ and} \end{aligned} \tag{18}$$

$$\begin{aligned} WF &= \mathrm{Min}P \\ &= \mathrm{Max}P \times \mathrm{Min}/\mathrm{Max} \\ &= (1+w)(1-\mathrm{Max})\mathrm{Min} + \mathrm{Max}^2\mathrm{Min}/(\mathrm{Max}-\mathrm{Min}) \\ &= (1-\mathrm{Max})\mathrm{Min} + w(1-\mathrm{Max})\mathrm{Min} + \\ &\quad \mathrm{Max}^2\mathrm{Min}/(\mathrm{Max}-\mathrm{Min}). \end{aligned} \tag{19}$$

Since both the values Max and Min are smaller than one, respective terms shown in Equations 17 to 19 have values in a range between zero and one. Therefore, when these are implemented by an application specific integrated circuit (ASIC), the calculation time for Equations 17 to 19 can be reduced because Equations 17 to 19 include multiplication, division, and addition of relatively small values.

Now, apparatus and method of converting image signals according to an embodiment of the present invention will be described with reference to FIGS. 8 and 9.

Figure 8:
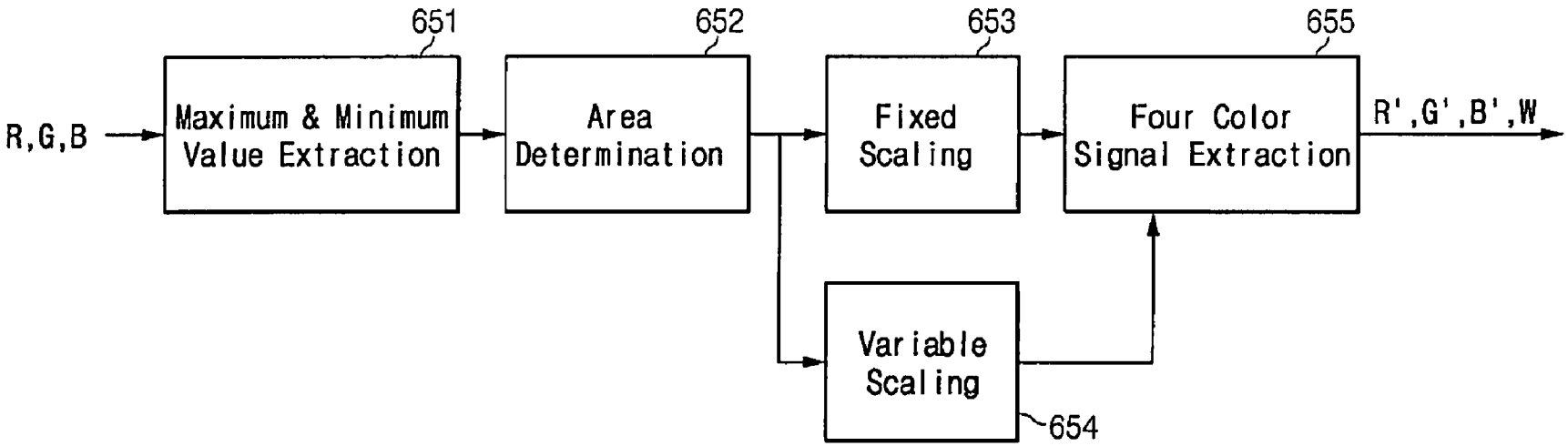
FIG. 8 is a block diagram of an image signal converting unit according to an embodiment of the present invention, which corresponds to a data processing unit shown in FIG. 1.
Figure 9:
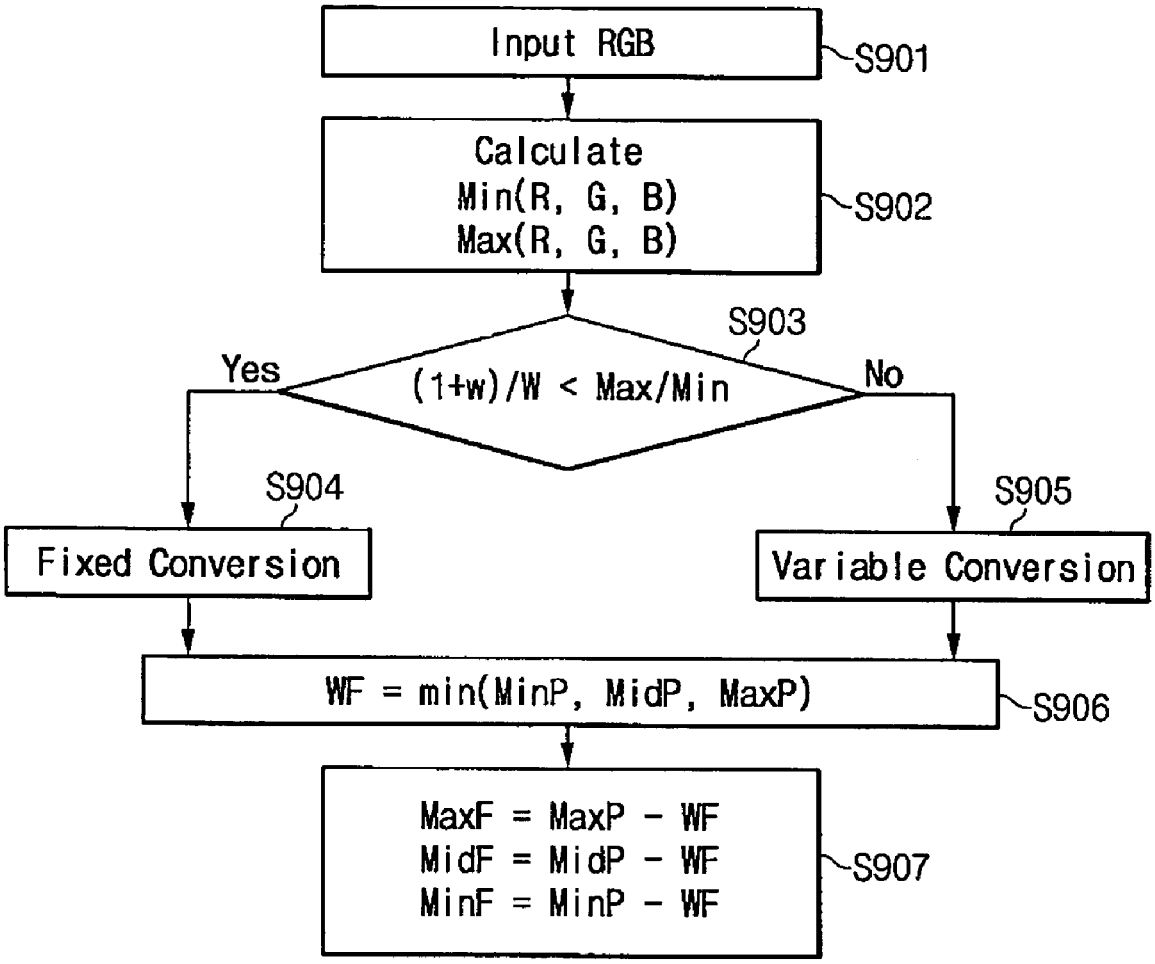
FIG. 9 is an exemplary flow chart for showing an operation of the image signal converting unit shown in FIG. 8.

FIG. 8 is a block diagram of an apparatus of converting image signals according to an embodiment of the present invention, which may correspond to the data processor 650 shown in FIG. 1, and FIG. 9 is an exemplary flow chart showing sequential operation of the apparatus shown in FIG. 8.

As shown in FIG. 8, an apparatus for converting image signals according to an embodiment of the present invention includes a maximum and minimum value extracting unit 651, an area determining unit 652 connected to the maximum and minimum value extracting unit 651, fixed and variable scaling units 653 and 654 connected to the area determining unit 652, and a four-color signal extracting unit 655 connected to the fixed and the variable scaling units 653 and 654.

When a set of red, green, and blue three-color image signals are inputted (S901), the maximum and minimum value extracting unit 651 compares the magnitude of the input image signals to seek a minimum value Min and a maximum value Max (S902). A middle value is automatically determined by the determination of the minimum and the maximum values.

Then, the determining unit 652 determines which of a fixed scaling area and a variable scaling area the set of input image signals belong to (S903). The area determining unit 652 determines that the input image signals belong to the fixed scaling area if Equation (1) (1+w)/w<Max/Min is satisfied, while, otherwise, it determines that the input image signals belong to the variable scaling area.

When the input image signals belong to the fixed scaling area, the fixed scaling unit 653 multiplies the minimum value Min, the maximum value Max and the middle value Mid with a scaling factor of (1+w) (S904). Alternatively, when the input image signals belong to the variable scaling area, the variable scaling unit 654 performs the mapping given by Equation 6 or 7 to calculate the intermediate values MaxP, MinP and MidP (S905).

The four-color signal extracting unit 655 extracts a value of a white signal from the outputs of the scaling unit 653 or 654 based on Equation 9 (S906), and thereafter, extracts values of the residual three-color signals (S907).

According to another embodiment of the present invention, the variable scaling unit 654 calculates only the values MaxP and MinP, and the four-color signal extracting unit 655 extracts four-color image signals based on Equation 11.

According to another embodiment of the present invention, without providing the four-color signal extracting unit 655, the scaling units 653 and 654 extracts four-color signals based on Equations 17 to 19, etc.

In this way, the increase of image data having high saturation or high luminance with the same ratio can prevent color-change or simultaneous contrast as well as indistinctiveness between grays.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. An apparatus of converting input three-color image signals into four-color image signals including a white signal and output three-color signals, the apparatus comprising:

a value extracting unit that extracts a maximum input and a minimum input among a set of input three-color image signals;

an area determining unit that determines which of scaling areas the set of input three-color image signals belong to on the basis of the maximum input and the minimum input; and a four-color converting unit that converts the set of input three-color image signals into a set of four-color signals depending on the area determination, wherein the scaling areas includes a fixed scaling area and a variable scaling area, and the four-color converting unit performs fixed scaling with a fixed scaling factor when the set of input three-color image signals belongs to the fixed scaling area and performs variable scaling when the set of input three-color image signals belongs to the variable scaling area depending on the set of input three-color image signals.

2. The apparatus of claim 1, wherein the variable scaling increases a value of the set of input three-color image signals by an increment smaller than the fixed scaling.

3. The apparatus of claim 2, wherein the fixed scaling comprises:

an increasing mapping that multiplies the scaling factor to the set of input three-color image signals to generate increased values; and an extraction that makes a minimum value among the increased values be a white signal and makes the increased values subtracted by the minimum value be output three-color signals.

4. The apparatus of claim 3, wherein the variable scaling comprises:

an increasing mapping that multiplies the scaling factor to the set of input three-color image signals to generate increased values;

a decreasing mapping that decreases the increased values depending on values of the set of input three-color image signals to generate decreased values; and an extraction that makes a minimum value among the decreased values be a white signal and makes the decreased values subtracted by the minimum value be output three-color signals.

5. The apparatus of claim 4, wherein the decreasing mapping classifies the increased values into at least two sub-regions and applies different functions to different sub-regions.

6. The apparatus of claim 5, wherein the at least two sub-regions are classified based on a maximum of the increased values.

7. The apparatus of claim 5, wherein the number of the at least two sub-regions is more than two and the functions are linear.

8. The apparatus of claim 5, wherein at least one of the functions is nonlinear.

9. The apparatus of claim 5, wherein at least one of the functions is quadratic.

10. The apparatus of claim 1, wherein the fixed scaling area and the variable scaling area are determined by a ratio of the maximum input and the minimum input.

11. The apparatus of claim 1, wherein the variable scaling area includes at least two sub-areas and the variable scaling applies different functions to the at least two sub-areas.

12. The apparatus of claim 11, wherein the number of the at least two sub-areas of the variable scaling area is more than two and the functions are linear.

13. The apparatus of claim 11, wherein at least one of the functions is nonlinear.

14. The apparatus of claim 11, wherein at least one of the functions is quadratic.

15. An apparatus of converting input three-color image signals into four-color image signals including a white signal and output three-color signals, the apparatus comprising:

a value extracting unit that extracts a maximum input and a minimum input among each set of input three-color image signals;

an area determining unit that determines which of a fixed scaling area and a variable scaling area each set of input three-color image signals belong to on the basis of a ratio of the maximum input and the minimum input; and a four-color signal generating unit that converts each set of input three-color image signals into a set of four-color signals, the conversion applying a different mapping to a first set of input three-color image signals belonging to the fixed scaling area from a mapping applied to a second set of input three-color image signals belonging to the variable scaling area, wherein the four-color signal generating unit:

for the second set of input three-color image signals, classifies first converted values, which are generated by multiplying a scaling factor to the second set of input three-color image signals, into at least two sub-regions, applies different functions to the at least two sub-regions to generate second converted values, and makes a minimum value among the second converted values be a white signal and makes the second converted values subtracted by the minimum value be output three-color signals; and for the first set of input three-color image signals, makes a minimum value among converted values, which are generated by multiplying the scaling factor to the first set of input three-color image signals, be a white signal and makes the converted values subtracted by the minimum value be output three-color signals.

16. The apparatus of claim 15, wherein the second converted values are equal to or smaller than the first converted values.

17. The apparatus of claim 16, wherein the sub-regions are partitioned by a line represented by $y=[(w+v1)/w]x+(1-v1)$ $(0<v1<1)$, where x and y are minimum and maximum of the first converted values and $(1+w)$ is the scaling factor.

18. The apparatus of claim 17, wherein the second converted values for a sub-region disposed under the line $y=[(w+v1)/w]x+(1-v1)$ are equal to the first converted values therefor, at least one of the second converted values for a sub-region disposed over the line $y=[(w+v1)/w]x+(1-v1)$ is a linear or quadratic function of the first converted values therefor, and the linear function has a gradient smaller than one.

19. The apparatus of claim 18, wherein the number of the sub-regions is at least three and the sub-regions are partitioned by a first line represented by $y=[(w+v1)/w]x+(1-v1)$ $(0<v1<1)$ and a second line represented by $y=(1-v2)x+(1+w*v2)(0<v2<1)$, where x and y are minimum and maximum of the first converted values and $(1+w)$ is the scaling factor.

20. The apparatus of claim 17, wherein the second converted values for a sub-region disposed under the first line are equal to the first converted values therefor, the second converted values for a sub-region disposed between the first line and the second line are linear functions of the first converted values therefor having a gradient smaller than one, and the second converted values for a sub-region disposed over the second line are constants independent of the first converted values therefor.

21. A method of converting input three-color image signals including red, green, and blue signals into four-color image signals including a white signal and output three-color signals, the method comprising:

classifying input three-color image signals forming a set into maximum, minimum, and middle;

determining which of a first conversion area and a second conversion area the set of input three-color image signals belong to based on a ratio of the maximum and the minimum;

multiplying a multiplier to the input three-color image signals that belong to the first conversion area;

converting the input three-color image signals belonging to the second conversion area into converted values that are larger than the input three-color image signals and smaller than the input three-color image signals multiplied by the multiplier;

extracting a minimum of the converted values as a white signal; and extracting the converted values subtracted by the minimum of the converted values as output three-color signals.

22. The method of claim 21, wherein the conversion comprises:

generating the first converted values by multiplying the multiplier to the input three-color image signals;

classifying the first converted values into a plurality of sub-regions; and converting the first converted values into the second converted values by applying different functions to the sub-regions.

23. The method of claim 22, wherein at least one of the functions is linear.

24. The method of claim 23, wherein the functions comprise three lines having different gradients.

25. The method of claim 24, wherein at least one of the lines has a gradient larger than zero and smaller than one.

26. The method of claim 23, wherein the functions comprise a nonlinear function.

27. The method of claim 26, wherein the functions comprise a quadratic function.

28. The method of claim 27, wherein the functions further comprise a nonlinear function.

29. The method of claim 28, wherein the quadratic function has a tangential gradient equal to a gradient of the linear function at a boundary of the sub-regions.

30. The method of claim 29, wherein a gradient of the linear function is equal to one.

31. A display device including a plurality of pixels, the display device comprising:

an image signal converter converting input three-color image signals into four-color image signals including a white signal and output three-color signals; and a data driver supplying data voltages corresponding to the four-color image signals to the pixels, wherein the image signal converter comprises:

a value extracting unit that extracts a maximum input and a minimum input among a set of input three-color image signals;

an area determining unit that determines which of scaling areas the set of input three-color image signals belong to on the basis of the maximum input and the minimum input; and a four-color converting unit that converts the set of input three-color image signals into a set of four-color signals depending on the area determination, wherein the scaling areas includes a fixed scaling area and a variable scaling area, and the four-color converting unit performs fixed scaling with a fixed scaling factor when the set of input three-color image signals belongs to the fixed scaling area and performs variable scaling when the set of input three-color image signals belongs to the variable scaling area depending on the set of input three-color image signals.

32. The display device of claim 31, wherein the variable scaling increases a value of the set of input three-color image signals by an increment smaller than the fixed scaling.

33. The display device of claim 32, wherein the fixed scaling comprises:

an increasing mapping that multiplies the scaling factor to the set of input three-color image signals to generate increased values; and an extraction that makes a minimum value among the increased values be a white signal and makes the increased values subtracted by the minimum value be output three-color signals.

34. The display device of claim 33, wherein the variable scaling comprises:

an increasing mapping that multiplies the scaling factor to the set of input three-color image signals to generate increased values;

a decreasing mapping that decreases the increased values depending on values of the set of input three-color image signals to generate decreased values; and an extraction that makes a minimum value among the decreased values be a white signal and makes the decreased values subtracted by the minimum value be output three-color signals.

35. The display device of claim 34, wherein the decreasing mapping classifies the increased values into at least two sub-regions and applies different functions to different sub-regions.

36. The display device of claim 35, wherein the at least two sub-regions are classified based on a maximum of the increased values.

37. The display device of claim 35, wherein the number of the at least two sub-regions is more than two and the functions are linear.

38. The display device of claim 35, wherein at least one of the functions is nonlinear.

39. The display device of claim 35, wherein at least one of the functions is quadratic.

40. The display device of claim 31, wherein the fixed scaling area and the variable scaling area are determined by a ratio of the maximum input and the minimum input.

41. The display device of claim 31, wherein the variable scaling area includes at least two sub-areas and the variable scaling applies different functions to the at least two sub-areas.

42. The display device of claim 41, wherein the number of the at least two sub-areas of the variable scaling area is more than two and the functions are linear.

43. The display device of claim 41, wherein at least one of the functions is nonlinear.

44. The display device of claim 41, wherein at least one of the functions is quadratic.

* * * * *